US012053680B2

(12) United States Patent
Kusumoto

(10) Patent No.: US 12,053,680 B2
(45) Date of Patent: Aug. 6, 2024

(54) GOLF EQUIPMENT BAG AND GOLF BALL MARKER ADHESION STRUCTURE

(71) Applicant: AQUA LLC, Osaka (JP)

(72) Inventor: Tetsuya Kusumoto, Osaka (JP)

(73) Assignee: AQUA LLC, Osaka (JP)

( * ) Notice: Subject to any disclaimer, the term of this patent is extended or adjusted under 35 U.S.C. 154(b) by 0 days.

(21) Appl. No.: 18/548,209

(22) PCT Filed: Sep. 30, 2022

(86) PCT No.: PCT/JP2022/036668

§ 371 (c)(1),
(2) Date: Aug. 28, 2023

(87) PCT Pub. No.: WO2023/079874

PCT Pub. Date: May 11, 2023

(65) Prior Publication Data

US 2024/0082669 A1 Mar. 14, 2024

(30) Foreign Application Priority Data

Nov. 8, 2021 (JP) ..... 2021-181923
Jun. 24, 2022 (JP) ..... 2022-101771

(51) Int. Cl.
*A63B 55/00* (2015.01)
*A63B 57/20* (2015.01)
*A63B 57/35* (2015.01)

(52) U.S. Cl.
CPC ..... *A63B 55/408* (2015.10); *A63B 57/207* (2015.10); *A63B 57/35* (2015.10)

(58) Field of Classification Search
CPC ..... A63B 55/408; A63B 57/207; A63B 57/35
USPC ..... 206/315.1, 818
See application file for complete search history.

(56) References Cited

U.S. PATENT DOCUMENTS 5,996,116 A * 12/1999 Tate ..... A63B 57/207 2/200.1
8,917,154 B2 * 12/2014 Fullerton ..... H01F 7/0278 335/297
2010/0193559 A1 8/2010 Huyssteen et al.

FOREIGN PATENT DOCUMENTS

JP S5072358 U 6/1975
JP H03118775 U 12/1991
JP H065657 U 1/1994

(Continued)

OTHER PUBLICATIONS

Decision to Grant for JP Patent Application No. 2022-101771 of Jul. 13, 2022.

(Continued)

*Primary Examiner* — Andrew D Perreault
(74) *Attorney, Agent, or Firm* — Perilla Knox & Hildebrandt LLP; Kenneth A. Knox

(57) ABSTRACT

A golf equipment case and a golf marker adsorption structure are described, which are operable to adsorb a golf marker regardless of the type. The golf equipment case for housing golf equipment includes a marker adsorption part that adsorbs a golf marker, wherein the marker adsorption part comprises a pair of magnets and a support part that supports the magnets, and wherein the pair of magnets of the marker adsorption part is arranged adjacent to each other and have different magnetic poles facing the side where the golf marker is attracted.

6 Claims, 10 Drawing Sheets

(56) References Cited

FOREIGN PATENT DOCUMENTS

JP 3119536 U 3/2006

OTHER PUBLICATIONS

International Search Report for International Application No. PCT/JP2022/036668 of Dec. 29, 2022.
Written Opinion for International Application No. PCT/JP2022/036668 of Dec. 29, 2022.

* cited by examiner

GOLF EQUIPMENT BAG AND GOLF BALL MARKER ADHESION STRUCTURE

CROSS-REFERENCE TO RELATED APPLICATIONS

The present disclosure is a national phase application under 35 U.S.C. § 371 of International Application No. PCT/JP2022/036668 filed Sep. 30, 2022, which claims the benefit of and priority to JP Patent Application No. 2021-181923 filed Nov. 8, 2021, and JP Patent Application No. 2022-101771 filed Jun. 24, 2022, the contents of all of which being incorporated by reference in their entireties herein.

TECHNICAL FIELD

This disclosure relates to a golf equipment case and a golf marker adsorption structure.

More specifically, the present disclosure relates to a golf equipment case or, for example, a golf ball holder, which can store at least two golf balls, and which has an insertion port with an opening/closing flap for inserting golf balls at one end, and which has a receiving part for receiving golf balls and pushing out golf balls inside with an ejection opening for inserting a finger at the other end, has been proposed.

BACKGROUND

When playing golf, it is necessary to carry a golf marker as well as a golf ball. The above-mentioned golf ball holder has a magnetic absorption part or a slit as an attachment part for attaching the magnetic absorption part so that the player can carry golf markers.

However, there are types of golf markers that use a magnetic material in addition to types that use a magnet. In this case, if the magnet has the opposite polarity against the magnetic absorption part of the golf ball holder, the magnet will absorb the golf ball holder. However, if the polarity does not match, the magnet will not absorb it.

The present disclosure has been made in view of the above-mentioned problems and has an objective to provide a golf equipment case and a golf marker adsorption structure, which are operable to adsorb a golf marker regardless of its type.

BRIEF SUMMARY

According to an embodiment of the present disclosure in order to solve the above-mentioned problems, a golf equipment case for housing golf equipment, the golf equipment case comprising: a marker adsorption part that adsorbs a golf marker having a magnet, wherein the marker adsorption part comprises a pair of magnets and a support part (221) that supports the magnets, wherein the pair of magnets of the marker adsorption part is arranged adjacent to each other and have different magnetic poles facing the side where the golf marker is attracted, and wherein the golf marker is absorbed by either of the pair of magnets.

As for the golf equipment case, wherein the marker adsorption part comprises an auxiliary support part that covers the pair of magnets, and wherein the pair of magnets are sandwiched between the support part and the auxiliary support part.

As for the golf equipment case, the golf equipment case further comprising: a housing part that houses golf equipment; and a lid part that covers an entrance of the housing part, wherein the marker adsorption part is equipped with the lid part, wherein the housing part comprises a fastener having at least one of a magnetic material and a magnet, and wherein the lid part is fastened with the housing part using the marker adsorption part and the fastener.

As for the golf equipment case, wherein one of the pair of magnets of the marker adsorption part is arranged closer to the entrance than the other, and wherein a main body part of the fastener that fastens the marker absorption part is composed of a magnetic material.

As for the golf equipment case, wherein the golf equipment case is a golf ball case or a golf rangefinder case.

According to an embodiment of the present disclosure in order to solve the above-mentioned problems, a golf marker adsorption structure for absorbing a golf marker having a magnet, comprising: a pair of magnets; and a support part that supports the magnets, wherein the pair of magnets is arranged adjacent to each other and have different magnetic poles facing the side where the golf marker is attracted, and wherein the golf marker is absorbed by either of the pair of magnets.

The present disclosure can provide a golf equipment case and a golf marker adsorption structure, which are operable to adsorb a golf marker regardless of the type.

The above-mentioned problems, configurations, and effects will be clarified by the following description of the embodiments.

BRIEF DESCRIPTION OF DRAWINGS

FIG. 2(*b*) is a rear view of an example of the golf equipment case shown in FIG. 1.

FIG. 3(*b*) is a right-side view of an example of the golf equipment case shown in FIG. 1.

FIG. 4(*b*) is a bottom view of an example of the golf equipment case shown in FIG. 1.

FIG. 5(*b*) is a cross-sectional view along BB' line in FIG. 3(*b*).

FIG. 6(*b*) is a plane view of an example when the lid part of the golf equipment case shown in FIG. 1 is opened.

FIG. 7(*b*) is a cross-sectional view along DD' line in FIG. 2(*a*).

DETAILED DESCRIPTION

Hereinafter, examples of embodiments of the present disclosure will be described with reference to the drawings. It is noted that components, which are common to the following embodiments (and modifications), may be denoted by the same reference numbers as those described above, and the description of the components may be omitted. In addition, when referring to the shape and positional relationship of the components, etc., unless otherwise specified or clearly considered otherwise in principle, etc., the things that substantially approximate or similar to the shape, etc. should be included.

Figure 1:
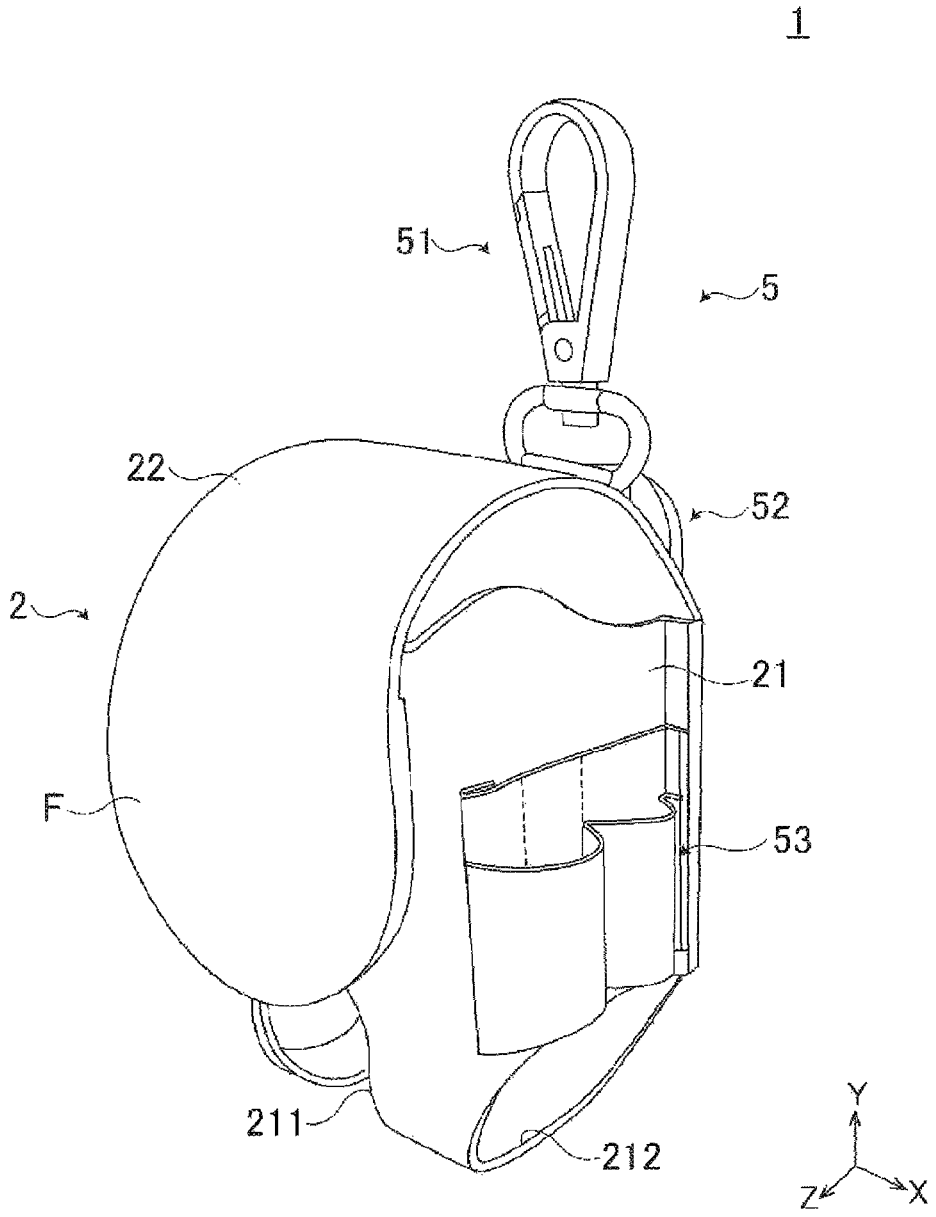
FIG. 1 is a perspective diagram showing an example of a golf equipment case according to the present disclosure.
Figure 2B:
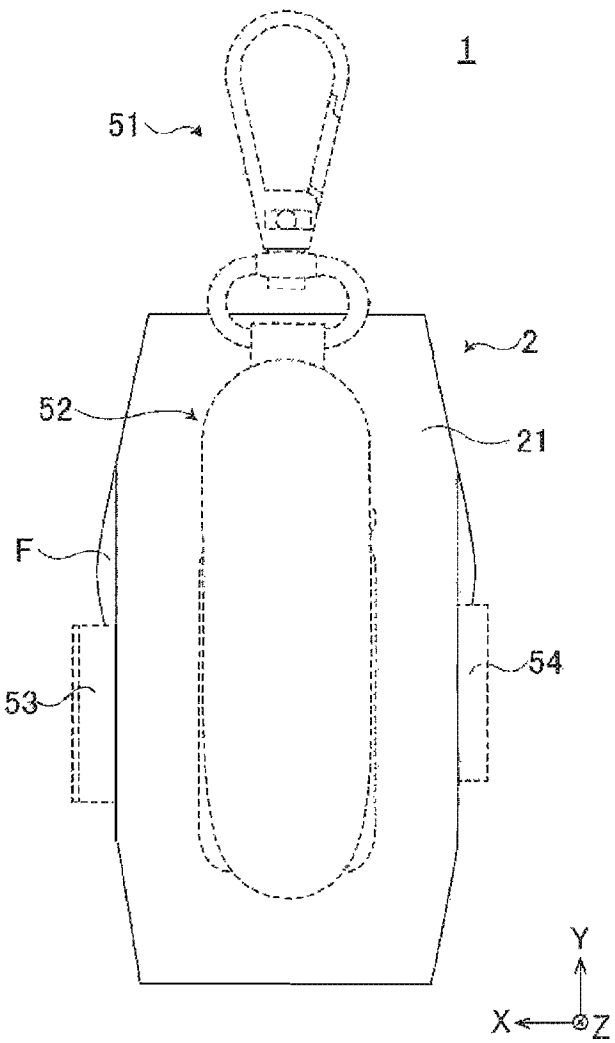
FIG. 2(*a*) is a front view of an example of the golf equipment case shown in FIG. 1.
Figure 2A:
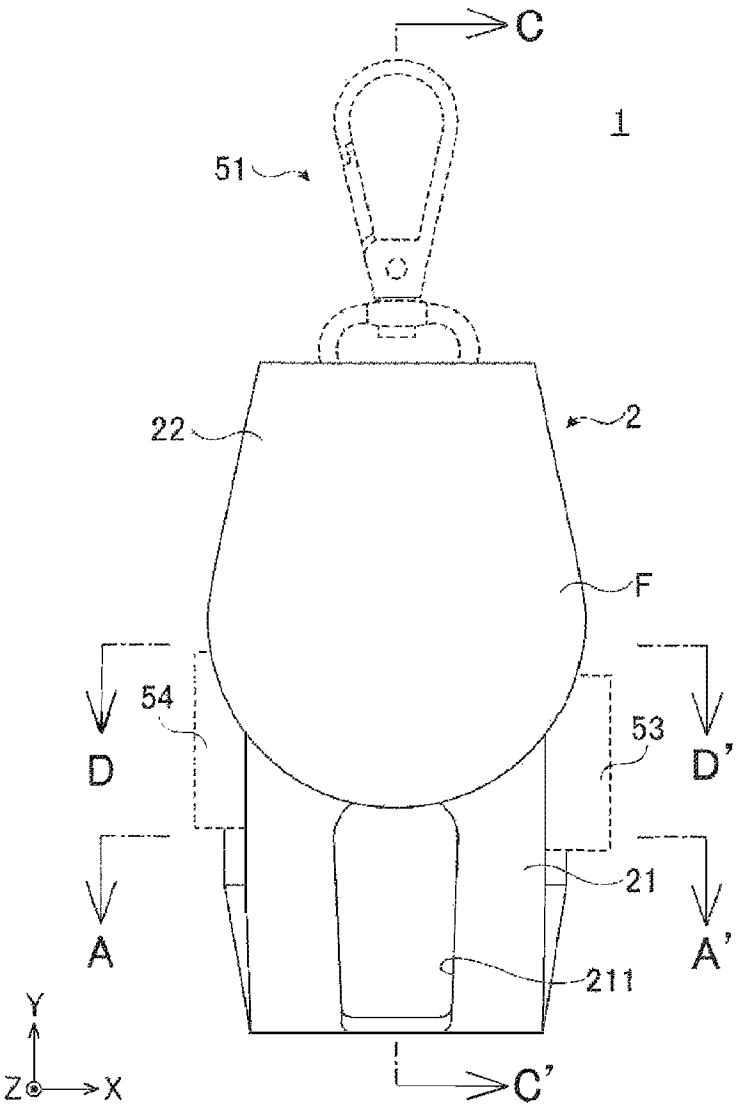

FIG. 1 is a perspective view showing an example of a golf equipment case according to the present disclosure. Herein, X is the left-right direction (horizontal direction) (−X is left, +X is right), Y is the vertical direction (−Y is downward, +Y is upward), and Z is the front-back direction (depth direction) (—Z is backward, +Z is forward) (hereinafter, the same applies to each figure).

The golf equipment case, according to the present disclosure, is to store golf equipment, and an example thereof is a golf ball case. Herein, the case refers to a portable tool in which things are put, regardless of the material. The golf equipment case, according to the present disclosure, comprises a marker adsorption part that adsorbs a golf marker. Hereinafter, a golf ball case will be described below as an example of the golf equipment case.

First, the overall configuration of a golf ball case according to one example of the present disclosure, will be described. FIGS. 2 to 6 are figures showing an example of the golf ball case, FIG. 2(*a*) is a front view, FIG. 2(*b*) is a rear view, FIG. 3(*a*) is a left-side view, and FIG. 3(*b*) is a right-side view, FIG. 4(*a*) is a plane view, FIG. 4(*b*) is a bottom view, FIG. 5(*a*) is a cross-sectional view along the line AN shown in FIG. 2(*a*), and FIG. 5(*b*) is BB' line sectional view shown in FIG. 3(*b*), FIG. 6(*a*) is a front view with the lid open, and FIG. 6(*b*) is a plane view with the lid open.

The golf ball case 1 comprises a main body 2, which is shown by solid lines in each figure. The main body 2 comprises a housing part 21 that stores a golf ball and a lid part 22 that covers the entrance of the housing part 21.

As shown by dashed lines in each figure (except FIG. 1), the golf ball case 1 may further comprise a ring-shaped fixture 51 and a clip-shaped fixture 52, for which the player attaches and carries the golf ball case 1. The golf ball case 1 may also comprise a tee storage part 53 that stores two or more golf tees and a green fork storage part 54 that stores a green fork.

As shown in the figures, as an example, the golf ball case 1 has a housing part 21 that is vertically long. The golf ball case 1 can house two golf balls pushed in from the entrance, wherein the two golf balls are stacked one above the other. The housing part 21 comprises a front part, a rear part, a left-side part, a right-side part, and a bottom part, and is opened upward to serve as the entrance.

The housing part 21 is provided with an ejection port 211 for ejecting the ball from the lower portion of the front part to the front portion of the bottom part. The housing part 21 is provided with side openings 212 between both side parts and the bottom part. As an example, the housing part 21 is formed of a piece of substantially T-shaped cloth.

The base end of the lid part 22 is continuous with the rear part of the housing part 21, and the front end of the lid part 22 overlaps the front part of the housing part 21 along the front-rear direction. Although the details will be described later, the lid part 22 has an overlapping part F that overlaps with the front part of the housing part 21, wherein the housing part 21 forms a case by connecting the overlapping part F both with a support part 221 and an auxiliary support part 222. The marker adsorption part 3 is arranged in this overlapping part F (see FIG. 7 and subsequent figures). In other words, the edges of the support part 221 and the auxiliary support part 222 are joined together by stitching, adhesion, or the like, except for the open part on the backside.

Figure 3B:
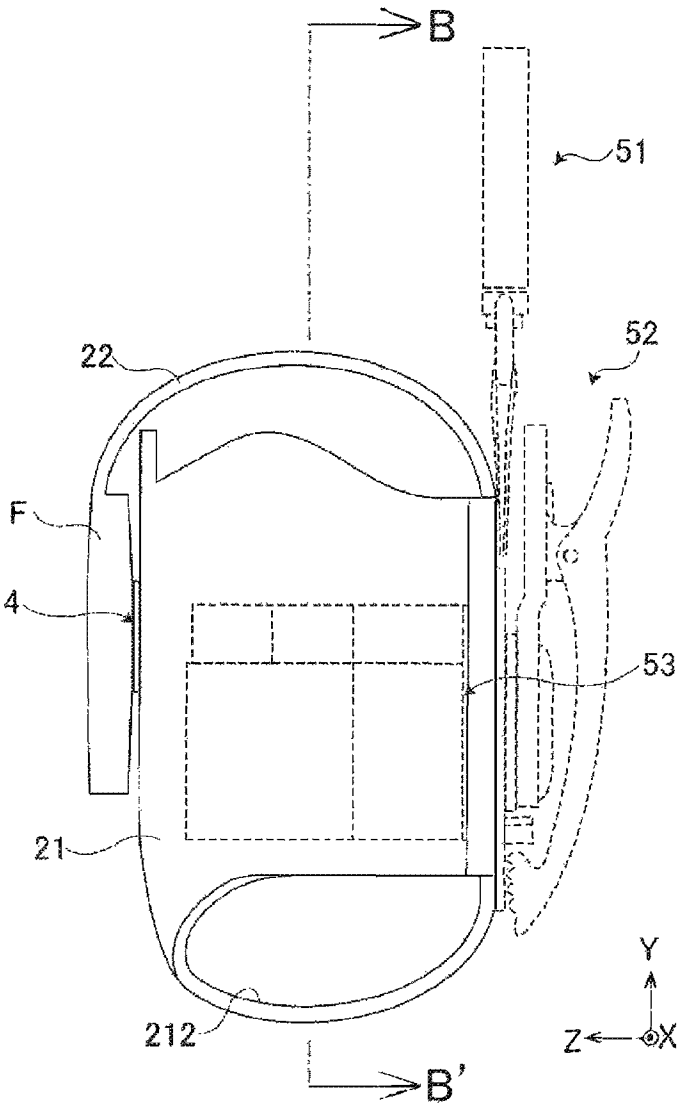
FIG. 3(*a*) is a left-side view of an example of the golf equipment case shown in FIG. 1.
Figure 3A:
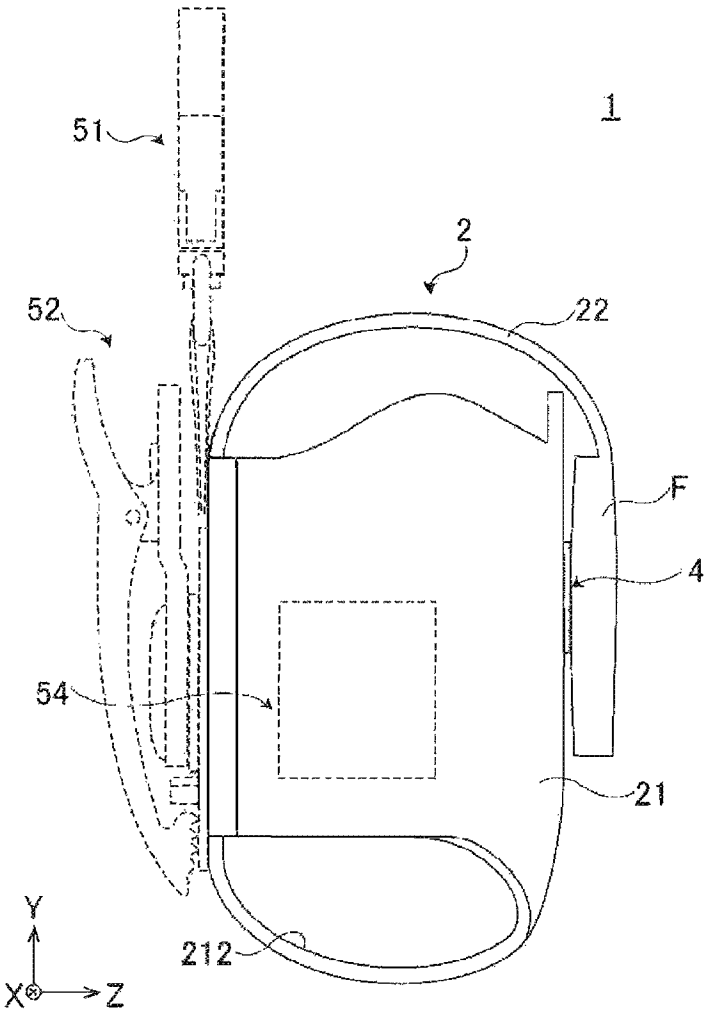
Figure 4B:
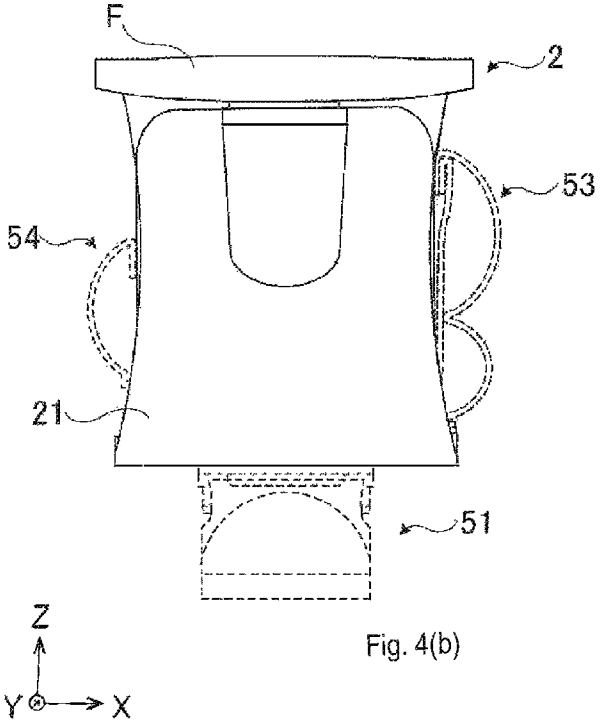
FIG. 4(*a*) is a plane view of an example of the golf equipment case shown in FIG. 1.
Figure 4A:
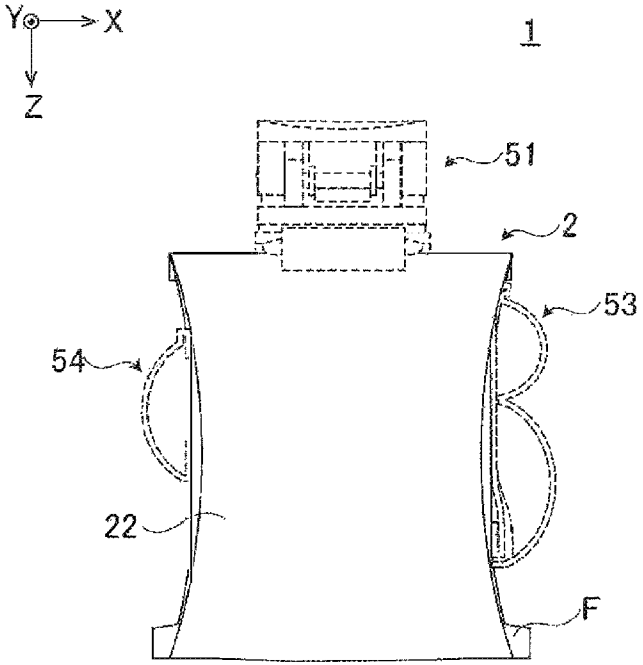
Figure 5B:
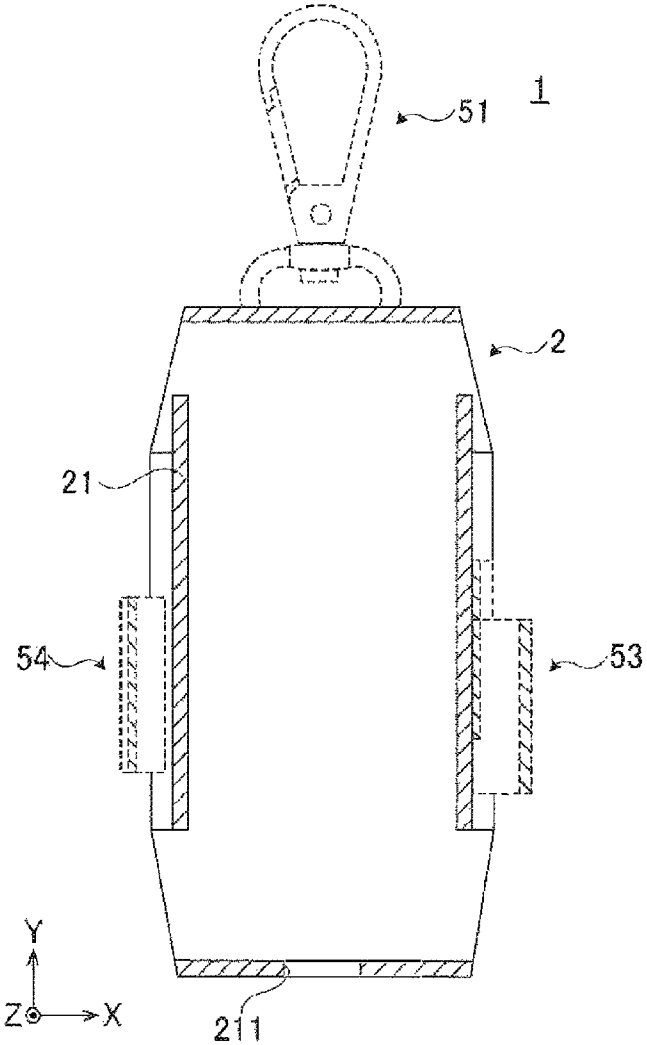
FIG. 5(*a*) is a cross-sectional view along AN line in FIG. 2(*a*).
Figure 5A:
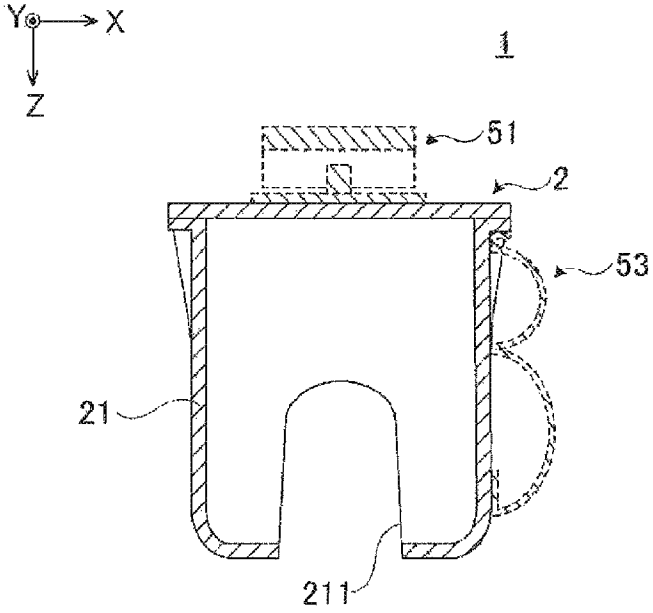

As shown in FIGS. 3 and 4, in terms of the lid part 22, the surface and the back surface of the overlapping part F have a slight convex shape when it is viewed from the left and right sides, from the top, and from the bottom. The golf marker M, which will be described later in detail, is attracted to the overlapping part F (refer to FIG. 8).

Figure 6B:
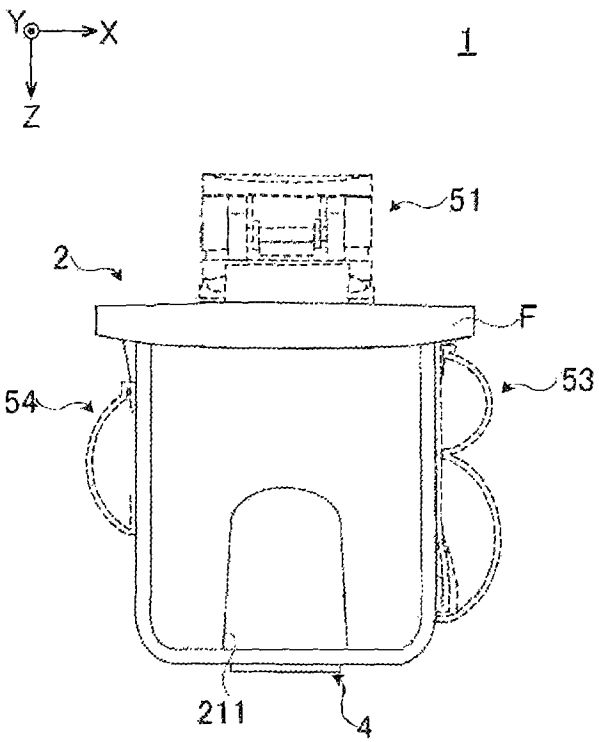
FIG. 6(*a*) is a front view of an example when the lid part of the golf equipment case shown in FIG. 1 is opened.
Figure 6A:
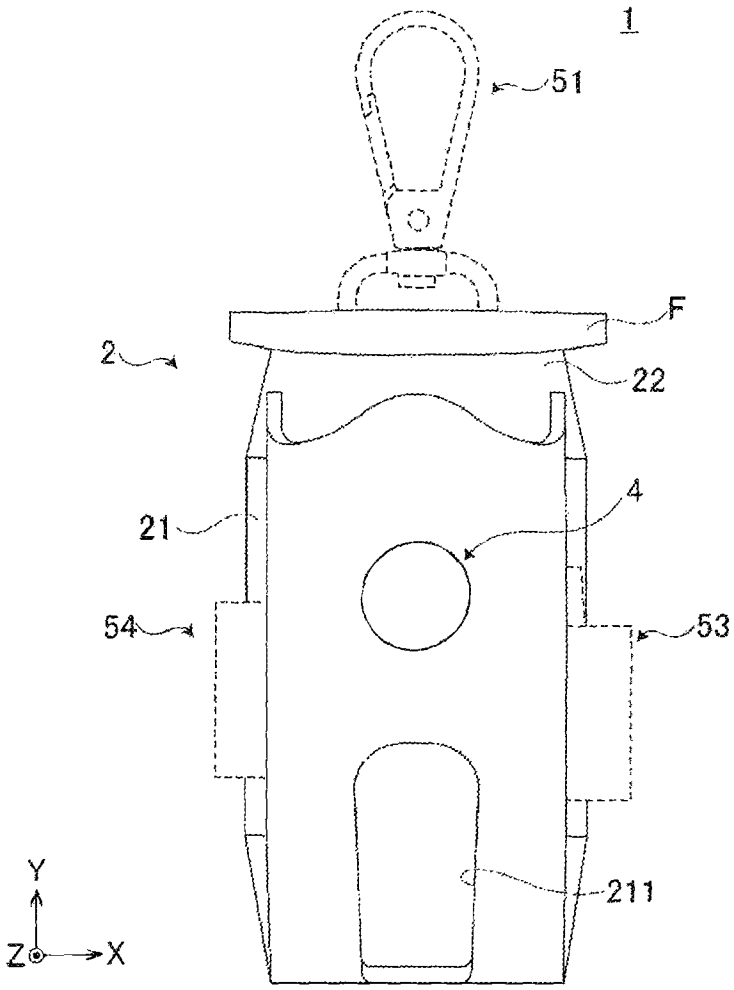

The golf ball case 1 can also be fixed by adsorbing the lid part 22 to the housing part 21. As shown in FIG. 6(*a*), the fastener 4 with at least one of a magnetic material and a magnet is equipped in the front part of the housing part 21. As shown in FIGS. 3 and 4, the overlapping part F is in contact with the fastener 4 and is fixed with the fastener 4, so that the closing condition is maintained.

As described above, the golf ball case 1 is equipped with the marker adsorption part 3 in an area of the overlapping part F of the lid part 22. The marker adsorption part 3 has the first role of adsorbing and holding the golf marker M and has the second role of adsorbing and fixing the lid portion 22 to the housing part 21.

Figure 7B:
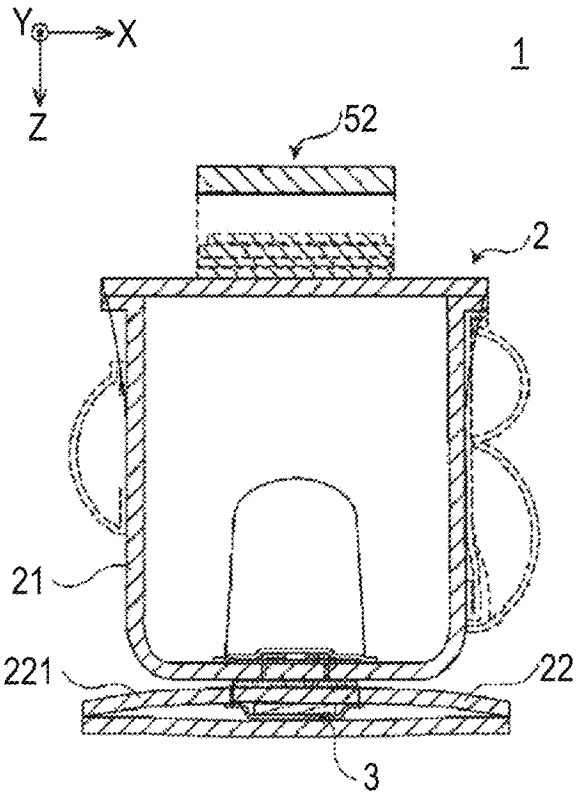
FIG. 7(*a*) is a cross-sectional view along CC' line in FIG. 2(*a*).
Figure 7A:
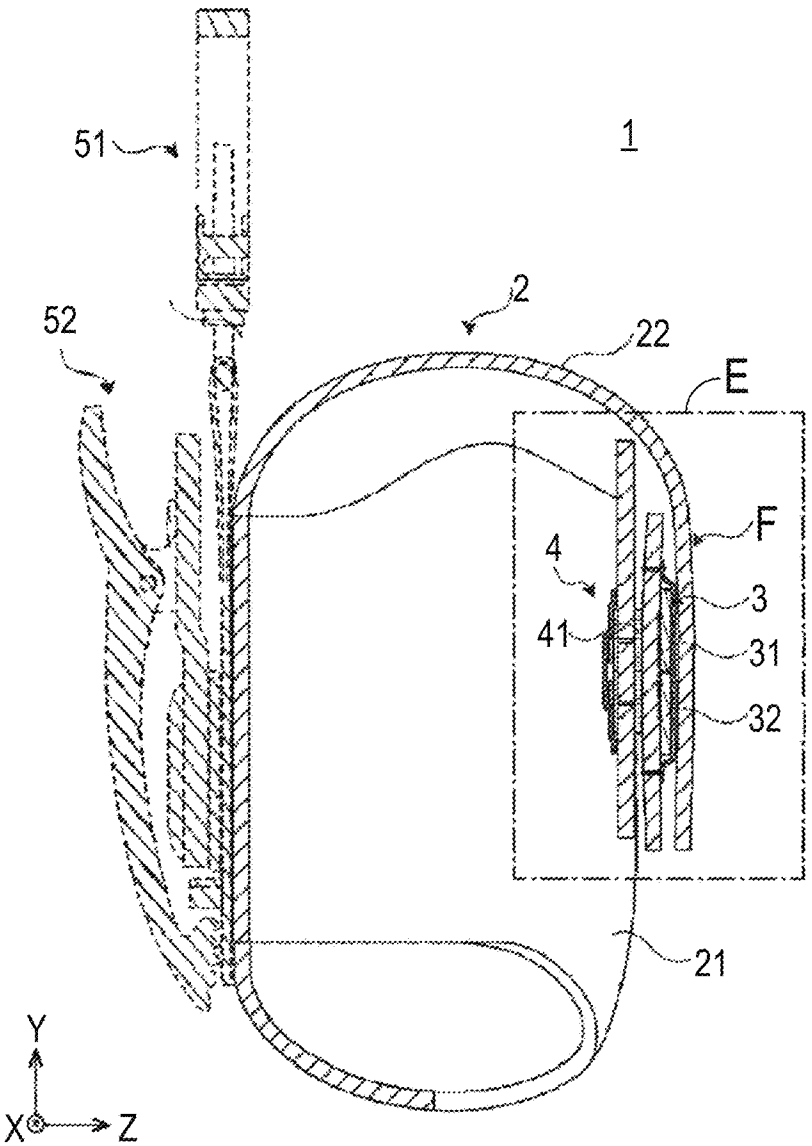
Figure 8A:
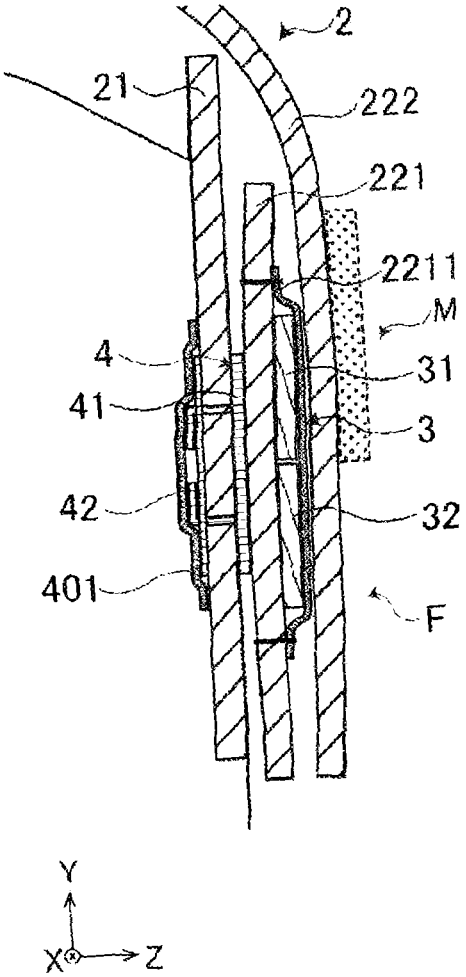
FIG. 8 is a diagram for explaining the marker absorption part using an enlarged E portion view shown in FIG. 7(*a*).

The marker absorption part 3 will be described in detail below. FIG. 7(*a*) is a cross-sectional view along line CC' in FIG. 2(*a*), FIG. 7(*b*) is a cross-sectional view along DD' line in FIG. 2(*a*), and FIG. 8 is a figure explaining a marker adsorption part using an enlarged view of part E in FIG. 7(*a*).

The marker absorption part 3 comprises a pair of magnets that are the first magnet 31 and the second magnet 32, and a support part 221 that supports the first magnet 31 and the second magnet 32. In other words, the support part 221 serves as a part of the lid part 22 and also serves as a support part for the first magnet 31 and the second magnet 32. As an example, the first magnet 31 and the second magnet 32 are supported by the support part 221 from the rear surface.

The marker absorption part 3 optically further comprises an auxiliary support part 222 that covers the first magnet 31 and the second magnet 32. In other words, the auxiliary support part 222 serves as a part of the lid part 22 and also serves as an auxiliary support part for the first magnet 31 and the second magnet 32. The first magnet 31 and the second magnet 32 are sandwiched between the support part 221 and the auxiliary support part 222.

The support part 221 has holding mean 2211 for holding the first magnet 31 and the second magnet 32 to prevent them from falling off (from shifting their positions). As an example, the holding mean 2211 is, as shown in the figure, a sheet-like cloth that is thinner than the cloth of the main body 2 and sewn to the support part 221 so as to surround the outer peripheries of the first magnet 31 and the second magnet 32. The holding mean 2211 may be the one which is a planar cloth adhered to the support part 221 so as to surround the outer peripheries of the first magnet 31 and the second magnet 32. The holding mean 2211 may be the one which is a material directly adhering the first magnet 31 and the second magnet 32 to the support portion 221.

The first magnet 31 and the second magnet 32 may be held on the surface of the support part 221. In other words, the support part 221 that holds and supports the first magnet 31 and the second magnet 32 may be arranged at the front side, which is the side that attracts the golf marker M, and the auxiliary support part 222 may be arranged at the reverse side, which is the opposite side of the front side.

In the marker adsorption part 3, the first magnet 31 and the second magnet 32 are supported by the support part 221 in the following manner. The first magnet 31 and the second magnet 32 are arranged adjacent to each other and have different magnetic poles facing the side where the golf marker M is attracted. In other words, when the N pole of the first magnet 31 faces the side where the golf marker M is attracted, the S pole of the second magnet 32 faces the side where the golf marker M is attracted. Conversely, when the S pole of the first magnet 31 faces the side where the golf marker M is attracted, the N pole of the second magnet 32 faces the side where the golf marker M is attracted.

As an example, the first magnet 31 and the second magnet 32 are arranged adjacent to each other (partially being in contact with the side surface other than the front and back surfaces). As an example, the first magnet 31 and the second magnet 32 are arranged adjacent to each other with a predetermined gap therebetween. In this case, the first magnet 31 and the second magnet 32 are optionally held by the support part 221 so as to maintain a predetermined distance by the holding mean 2211.

Herein, the first role of the marker absorption part 3 will be described in detail. There are two types of golf markers M that use magnetic force for attachment for carrying: a type that uses a magnetic material for attraction and a type that uses a magnet. The type using a magnet is further divided into different types depending on the polarity. The marker absorption part 3 of the present disclosure can attract any type of golf marker M with any magnet. Also, since it is sufficient to be attracted to either one of the magnets, it can be quickly attracted.

Figure 8B:
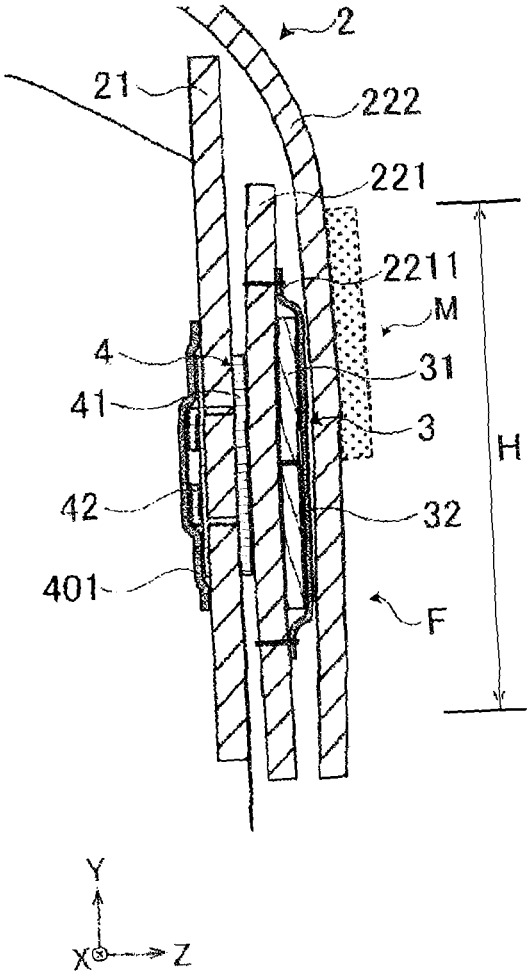

As shown in FIG. 8(*a*), if the golf marker M is the type that uses a magnet, the marker absorption part 3 can adapt to any polarity. In other words, the marker absorption part 3 can attract and hold the golf marker M by using one of the matching polarity among the first magnet 31 and the second magnet 32. As shown in FIG. 8B, when the golf marker M is the type using a magnetic material, the marker absorption part 3 can attract and hold the golf marker M by one or both of the first magnet 31 and the second magnet 32. In this case, as shown by H in the figure, the adsorption range becomes wider, so adsorption can be performed quickly.

As described above, since the marker adsorption part 3 can adsorb any type of golf marker M, the player can purchase and carry the golf marker M without being conscious of the type of the golf marker M. This will result in convenience for the players.

Next, the second role of the marker adsorption part 3 will be described in detail. In general, when a magnet fastener is used to open and close the entrance of the lid part 22, the female side (magnet) is arranged at the housing part 21, and the male side (magnetic material) is arranged at the lid part 22. Therefore, although the lid part 22 can be held by attraction, the golf marker M cannot be held by attraction.

On the other hand, as for the golf ball case 1, the housing portion 21 is provided with the fastener 4 having at least one of a magnetic material and a magnet, and the lid part 22 is provided with the marker attracting portion 3. With this configuration, not only the lid portion 22, but also the golf marker M can be held by absorption.

The fastener 4 can be fastened by one of the first magnet 31 and the second magnet 32 when the main part 41 that fastens the marker absorption part 3 is a magnet. On the other hand, when the main part 41 that holds the marker absorption part 3 is composed of a magnetic material, it can be held by one or both of the first magnet 31 and the second magnet 32.

In particular, in the latter case, as shown in the figures, in a case when one of the first magnet 31 and the second magnet 32 of the marker adsorption part 3 is arranged closer to the entrance than the other in a case when the first magnet 31 and the second magnet 32 are vertically arranged in a row, since the range of contacting the lid part 22 with the fastener 4 of is expanded vertically, the player can just cover the lid part 22 without concerning about the closing position of the lid part 22 so that the lid part 22 can be closed easily and quickly.

Herein, the fastener 4 shown in the figure has a main part 41 arranged on the surface of the front part, wherein both legs of the main part 41 are locked to the back surface of the front part by making the legs penetrate through the front part and the auxiliary fastener 42 and by making them bend. However, this is only an example, and the attachment structure of the fastener 4 is not particularly limited. In order for the foot part of the main part 41 and the auxiliary fastener 42 not to be touched by a golf ball, a covering part 401 may be provided to cover them.

Figure 9A:
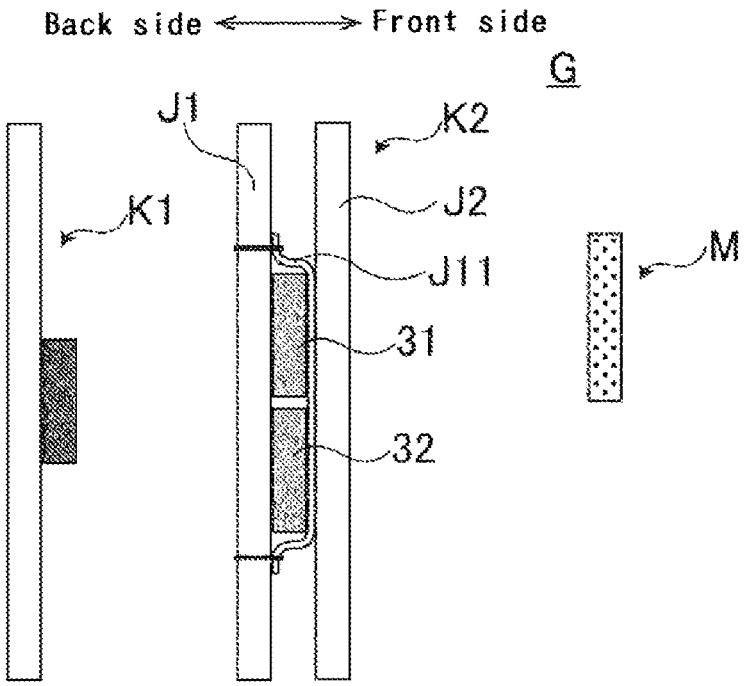
FIG. 9 is a conceptual diagram showing a golf marker adsorption structure according to the present disclosure.
Figure 9B:
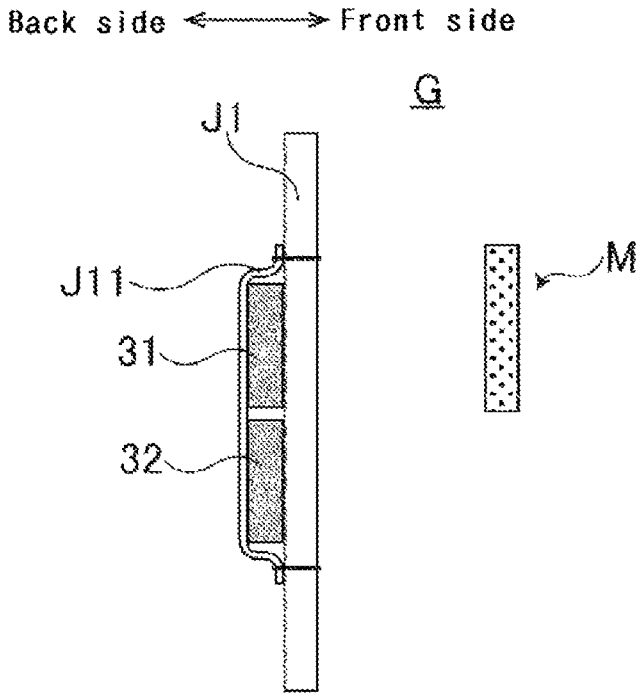

FIG. 9 is a conceptual diagram showing a golf marker adsorption structure according to the present disclosure.

As in the example of the marker adsorption part 3 of the golf ball case 1 described above, the golf marker adsorption structure G of the present disclosure is a structure for absorbing the golf marker M, and comprises a pair of the first magnet 31 and the second magnet 32 and a support J1 that supports the first magnet 31 and the second magnet 32. As for the golf marker absorption structure G, the first magnet 31 and the second magnet 32 are arranged adjacent to each other and have different magnetic poles facing the side where the golf marker M is attracted.

The first magnet 31 and the second magnet 32 are held on the support J1 with a certain holding mean J11 so as not to drop off from the support J1. As shown in FIG. 9(*a*), the first magnet 31 and the second magnet 32 may be arranged on the front side of the support J1 or may be arranged on the back side of the support J1 as shown in FIG. 9(*b*). As shown in FIG. 9(*a*), the golf marker adsorption structure G may further include an auxiliary support J2 to sandwich the first magnet 31 and the second magnet 32 with the support J1.

According to the golf marker adsorption structure G, any type of golf marker M can be adsorbed. Furthermore, as shown in FIG. 9(*a*), when the object to which the golf marker adsorption structure G is applied comprises the housing part K1 and the lid part K2, the lid part K2 can also be served as a fastener for fastening the housing part K1 by applying the lid portion K2. Thus, the golf marker adsorption structure G exhibits excellent effects in spite of its simple structure.

It is noted that even if the object to which the golf marker adsorption structure G is applied comprises the housing part K1 and the lid part K2, a hook-and-loop fastener, a conventional magnet fastener, or the like is used as the fastener that fastens the lid part K2 to the housing part K1. It is needless to say that the golf marker absorption structure G may be applied to the housing part K1 and other parts of the lid part K2 that do not overlap with the fastener. In this case, the golf marker adsorption structure G can adsorb the backup golf marker M on the back side regardless of the type.

As mentioned above, the golf marker adsorption structure G can adsorb the golf marker M not only on the front side but also on the back side, regardless of the type. As a result of this, the golf marker adsorption structure G exhibits excellent effects in spite of its simple structure.

The various examples of the present disclosure have been described above. However, the present disclosure may include various modifications. An example will be described below.

Figure 10A:
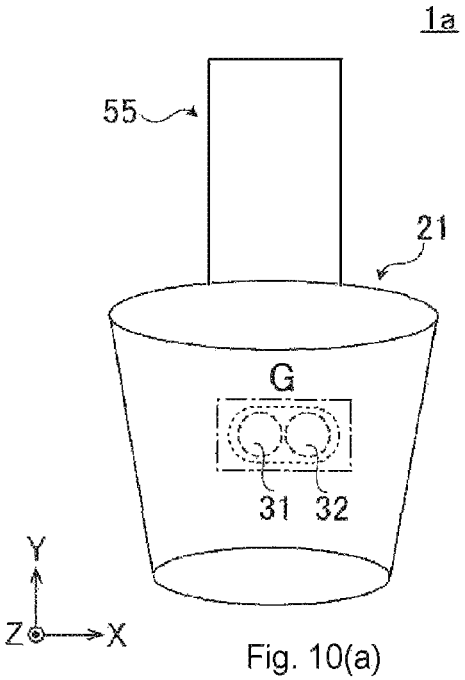
FIG. 10 is a diagram showing another example of a golf equipment case according to the present disclosure.
Figure 10B:
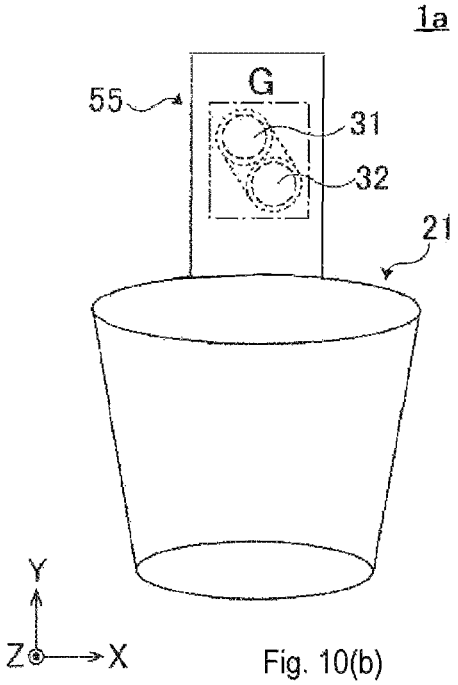

FIG. 10 is a diagram showing another example of the golf equipment case of the present disclosure. The golf ball case 1*a* shown in the figure comprises a housing part 21 and an attachment part 55 for attaching the golf ball case to a player's belt or the like. The golf ball case 1*a* does not comprise a lid part. The golf marker adsorption structure G may be applied to the housing part 21 shown in FIG. 10(*a*), or may be applied to the attachment part 55 shown in FIG. 10(*b*). In other words, the golf marker adsorption structure G can be applied at any part of the golf ball case 1*a*.

In addition, as for the golf marker adsorption structure G, the first magnets 31 and the second magnets 32 may be arranged adjacent to each other or may be arranged side by side in a horizontal row, as shown in FIG. 10(*a*). Alternatively, it may be arranged diagonally next to each other as shown in FIG. 10(*b*).

Furthermore, the golf marker adsorption structure G can be applied not only to a case for housing golf balls but also to a case for housing golf equipment, such as a golf rangefinder case that houses the golf rangefinder, a club case, and a caddy bag except for golf balls. In particular, a golf rangefinder case has a shape similar to a golf ball case. As a result, the golf marker adsorption structure G can be applied to a golf rangefinder case in the same manner as the golf ball case 1 and golf ball case 1*a*. Moreover, the present disclosure may be applied not only to cases for housing golf equipment but also to golf caps, golf wear, and the like worn by golf players.

As mentioned above, although the embodiment which concerns this disclosure has been described, these are only examples of this disclosure, and this disclosure is not limited to these. The present disclosure includes forms obtained by combining each of the above-described embodiments and modifications thereof, as well as various modifications. Various additions, changes, and partial deletions are possible without departing from the conceptual idea and spirit of the present disclosure derived from the content defined in the claims and equivalents thereof.

A summary of the reference signs is as follows: 1, 1*a*: golf ball case; 2: main body; 21: housing part; 22: lid part; 221: support part; 222: auxiliary support part; 3: marker absorption part; 31: first magnet; 32: second magnet; 4: fastener; 41: main part; G: marker absorption structure; J1: support; and J2: auxiliary support.

What is claimed is:

1. A golf ball case for housing a golf ball, the golf ball case comprising:

a marker adsorption part that adsorbs a golf marker having a magnet, wherein the marker adsorption part comprises a pair of magnets and a support part that supports the pair of magnets, wherein the pair of magnets of the marker adsorption part is arranged adjacent to each other and have different magnetic poles facing the side where the golf marker is attracted, and the golf marker is absorbed by either of the pair of magnets, and a housing part that houses the golf ball and a lid part that covers an entrance of the housing part, wherein the marker adsorption part is equipped with the lid part, wherein the housing part comprises a fastener having at least one of a magnetic material and a magnet, the lid part is fastened with the housing part using the marker adsorption part and the fastener, the lid part has an overlapping part that overlaps with the front part of the housing part, and the marker adsorption part is arranged in the overlapping part.

2. The golf ball case according to claim 1, wherein the marker adsorption part comprises an auxiliary support part that covers the pair of magnets, and the pair of magnets are sandwiched between the support part and the auxiliary support part.

3. The golf ball case according to claim 1, wherein one of the pair of magnets of the marker adsorption part is arranged closer to the entrance than the other, and wherein a main body part of the fastener that fastens the marker absorption part is composed of a magnetic material.

4. A golf rangefinder case for housing a rangefinder, comprising:

a marker adsorption part that adsorbs a golf marker having a magnet, wherein the marker adsorption part comprises a pair of magnets and a support part that supports the pair of magnets, wherein the pair of magnets of the marker adsorption part is arranged adjacent to each other and have different magnetic poles facing the side where the golf marker is attracted, and the golf marker is absorbed by either of the pair of magnets; and a housing part that houses the rangefinder and a lid part that covers an entrance of the housing part, wherein the marker adsorption part is equipped with the lid part, wherein the housing part comprises a fastener having at least one of a magnetic material and a magnet, the lid part is fastened with the housing part using the marker adsorption part and the fastener, the lid part has an overlapping part that overlaps with the front part of the housing part, and the marker adsorption part is arranged in the overlapping part.

5. The golf rangefinder case according to claim 4, wherein the marker adsorption part comprises an auxiliary support part that covers the pair of magnets, and the pair of magnets are sandwiched between the support part and the auxiliary support part.

6. The golf rangefinder case according to claim 4, wherein one of the pair of magnets of the marker adsorption part is arranged closer to the entrance than the other, and wherein a main body part of the fastener that fastens the marker absorption part is composed of a magnetic material.

* * * * *